US005199146A

United States Patent [19]

Grover et al.

[11] Patent Number: 5,199,146

[45] Date of Patent: Apr. 6, 1993

[54] TENSIONING AND CRIMPING TOOL

[75] Inventors: Donald D. Grover, Kenosha, Wis.; Theodore H. Kunkel, Jr., Cincinnati; Jeffery A. Stafford, Dayton, both of Ohio

[73] Assignee: Snap-on Tools Corporation, Kenosha, Wis.

[21] Appl. No.: 555,540

[22] Filed: Jul. 25, 1990

[51] Int. Cl.[5] ..... B23P 19/00

[52] U.S. Cl. ..... 29/268; 29/280; 29/282

[58] Field of Search ..... 29/252, 282, 255, 280, 29/788, 952, 268; 254/29 A

[56] References Cited

U.S. PATENT DOCUMENTS

| | | |
|---|---|---|
| 790,800 | 5/1905 | Merrill . |
| 847,776 | 3/1907 | Huising . |
| 1,147,845 | 7/1915 | Brooks . |
| 1,182,602 | 5/1916 | Tuohy . |
| 1,277,305 | 8/1918 | Gerrard . |
| 1,408,846 | 3/1922 | Turner . |
| 1,555,819 | 10/1925 | Baruch . |
| 1,807,479 | 5/1931 | James . |
| 2,267,532 | 12/1941 | Moberg . |
| 2,424,521 | 7/1947 | Utsch . |
| 2,643,687 | 6/1953 | Schlage et al. . |
| 2,764,861 | 10/1956 | Wenk, Jr. . |
| 2,779,566 | 1/1957 | Keeble . |
| 3,021,876 | 2/1962 | Hall et al. . |
| 3,032,075 | 5/1962 | Hall et al. . |
| 3,101,663 | 8/1963 | Hall et al. . |
| 3,129,728 | 4/1964 | Sharko . |
| 3,152,621 | 10/1964 | Meier . |
| 3,309,061 | 3/1967 | Plattner . |
| 3,353,227 | 11/1967 | Kabel . |
| 3,359,779 | 12/1967 | Filia . |
| 3,380,485 | 4/1968 | Plattner et al. . |
| 3,396,760 | 8/1968 | Kirsinas et al. . |
| 3,411,551 | 11/1968 | Plattner . |
| 3,492,854 | 2/1970 | Eppler . |
| 3,523,351 | 8/1970 | Filia . |
| 3,570,554 | 3/1971 | Kabel . |
| 3,636,861 | 1/1971 | Weller . |
| 3,658,296 | 4/1972 | Yegge . |
| 3,672,295 | 6/1972 | Weller . |
| 3,687,059 | 8/1972 | Plattner et al. . |
| 3,695,307 | 10/1972 | Kuoni . |
| 3,768,397 | 10/1973 | Plattner . |
| 3,888,105 | 6/1975 | Bert . |
| 3,911,970 | 10/1975 | Lundberg et al. . |
| 4,028,756 | 6/1977 | Couto . |
| 4,041,993 | 8/1977 | Angarola . |
| 4,043,174 | 8/1977 | Paolino . |
| 4,170,125 | 10/1979 | Minka . |
| 4,170,820 | 10/1979 | Klose . |
| 4,390,047 | 6/1983 | Kaneko . |
| 4,534,107 | 8/1985 | Maack . |
| 4,576,165 | 3/1986 | Green et al. . |
| 4,726,403 | 2/1988 | Young et al. . |
| 4,747,433 | 5/1988 | Dixon . |
| 4,928,738 | 5/1990 | Marelin et al. . |
| 4,947,901 | 8/1990 | Rancour et al. . |
| 5,052,094 | 10/1991 | Plasse et al. ..... 29/282 |

*Primary Examiner*—Robert C. Watson
*Attorney, Agent, or Firm*—Emrich & Dithmar

[57] ABSTRACT

The tool includes a housing and a pair of forwardly projecting tubes respectively containing slidably mounted rods, one for use in tensioning a lock wire and the other for use in crimping a ferrule onto the lock wire. Camming structure moves the rods forwardly and rearwardly. First, the tensioning rod snaps back under the control of a spring to tension the wire. Then, the ferrule is crimped by forward movement of the other rod.

75 Claims, 7 Drawing Sheets

TENSIONING AND CRIMPING TOOL

BACKGROUND OF THE INVENTION

This invention relates to a tool for use in applying lock wire to two or more threaded fasteners and specifically to such a tool which will tension the wire and then apply ferrules to the wire to hold it in place. In certain kinds of environments it is not sufficient simply to use nuts and bolts to hold parts together. In an airplane, for example, the loosening of a fastener could have disastrous consequences. Thus, it has been the practice for quite some time to use the type of fastener which has a hole extending transversely through the nut, the bolt head or the like and to pass a locking wire through two or more such fasteners. It has recently been proposed to apply ferrules to the ends of each wire passing through a set of fasteners.

SUMMARY OF THE INVENTION

It is an important object of the present invention to provide a tool which will tension the wire extending between two or more fasteners and then automatically crimp a ferrule to the wire so that the wire is retained in place.

Another object is to provide such a tool which can be adjusted so that the desired tensioning and crimping can be reliably achieved.

Another object is to provide such a tool which does not permit the operator to partially crimp a ferrule.

Another object is to provide such a tool which is hand-held, is portable and is easy to use.

Another object is to provide such a tool which may be operated manually.

Another object is to provide such a tool which may be operated manually or by an external power source.

Another object is to provide such a tool which is relatively small in size.

Another object is to preclude crimping a single ferrule twice.

In summary, there is provided a tensioning and crimping tool comprising means for tensioning a wire, means for crimping a ferrule onto the wire after the wire has been tensioned, and means for operating the tensioning means and the crimping means.

In a specific form of the invention, the tool comprises a housing, a tensioning tube projecting forwardly from the housing, a tensioning rod slidably mounted in the tensioning tube, means on the front end of the tensioning rod for gripping a wire, means for rearwardly biasing the tensioning rod, tensioning-rod operating means having a first portion restraining rearward movement of the tensioning rod and having a second portion for releasing the tensioning rod to cause tensioning of the wire, a crimping tube projecting forwardly from the housing and being substantially parallel to the tensioning tube, means at the front end of the crimping tube defining a ferrule chamber, a crimping rod slidably mounted in the crimping tube and extending from the chamber to the housing, crimping-rod operating means for moving the front end of the crimping rod into the chamber and thereby crimp a ferrule therein, and actuating means mounted in the housing for rotation about an axis substantially parallel to the axes of the tensioning and crimping rods and being coupled to both of the operating means.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
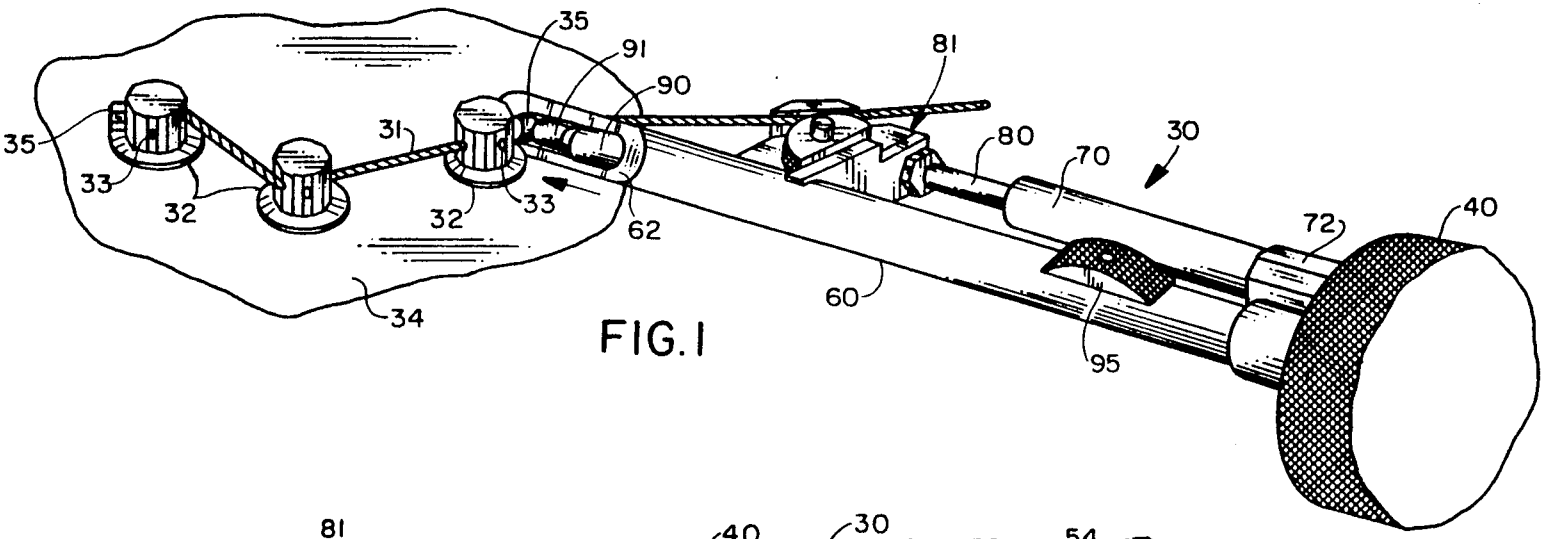
FIG. 1 is a perspective view of a fragmentary portion of a tool incorporating the features of the present invention being depicted tensioning a lock wire and crimping a ferrule thereon.

Turning now to the drawings and more particularly to FIG. 1 thereof, there is depicted the front portion of a tensioning and crimping tool 30 being used to apply a lock wire 31 to a series of bolts 32 each having a plurality of holes 33 through its head. The bolts 32 are used to attach a part 34 to another part (not shown). These bolts have a tendency to loosen during use of the device incorporating such parts. To preclude loosening, a lock wire 31 is threaded through one of the holes 33 in each bolt head. Prior to threading, a ferrule 35 is secured to one end of the lock wire. The wire must be tensioned in order that it will be effective in precluding loosening of the bolts. This is one of the purposes of the tool 30. After the wire is tensioned, continued operation of the tool will automatically crimp a ferrule 35 onto the wire. A ferrule is inserted into the tip of the tool and the wire is threaded through the ferrule and into mechanism that grips the wire. The tool 30 is actuated causing the wire to become tensioned and then automatically to crimp the ferrule. The tool is then detached from the wire and used again.

Figure 4:
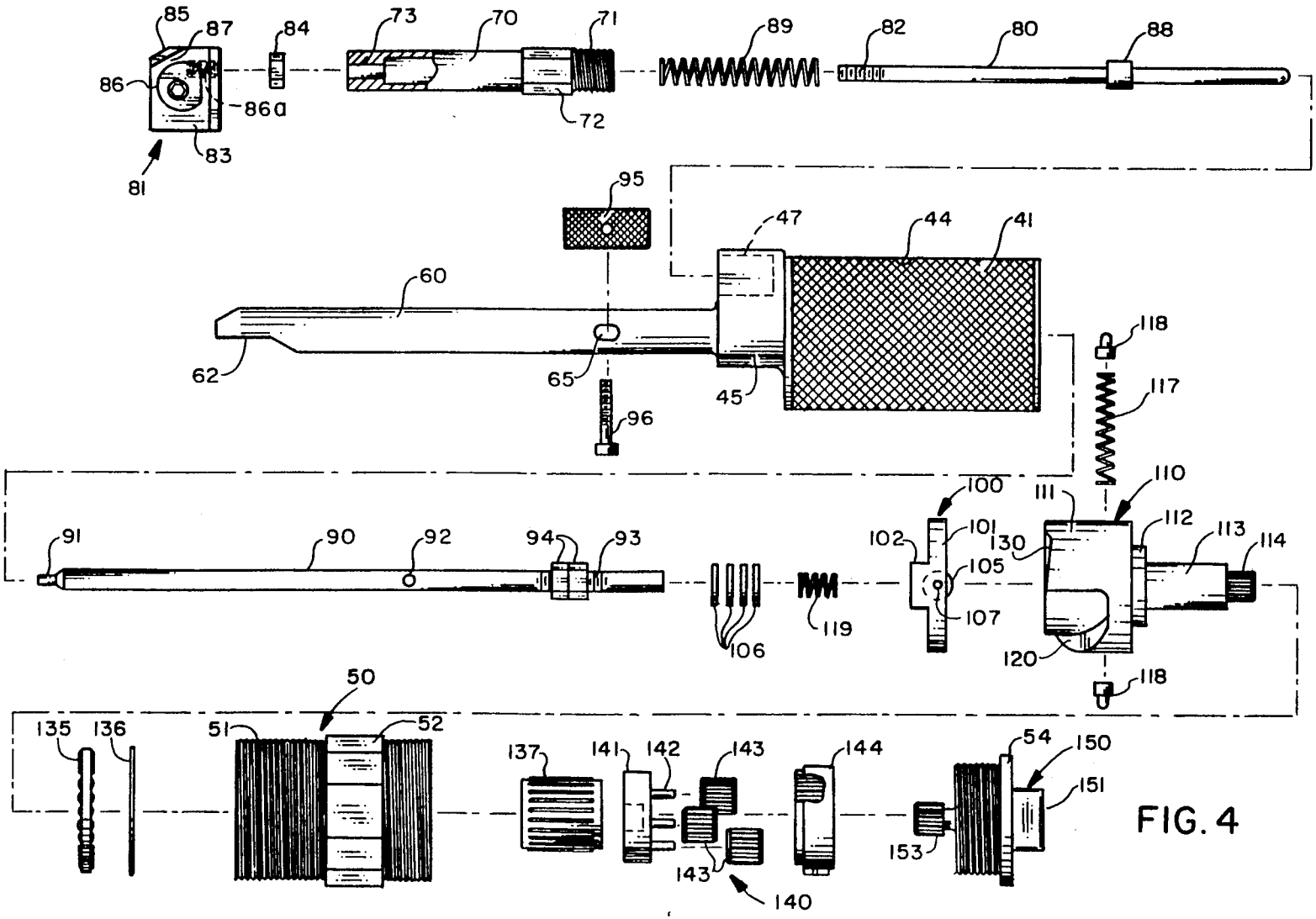
FIG. 4 is an exploded view of the tool.
Figure 5:
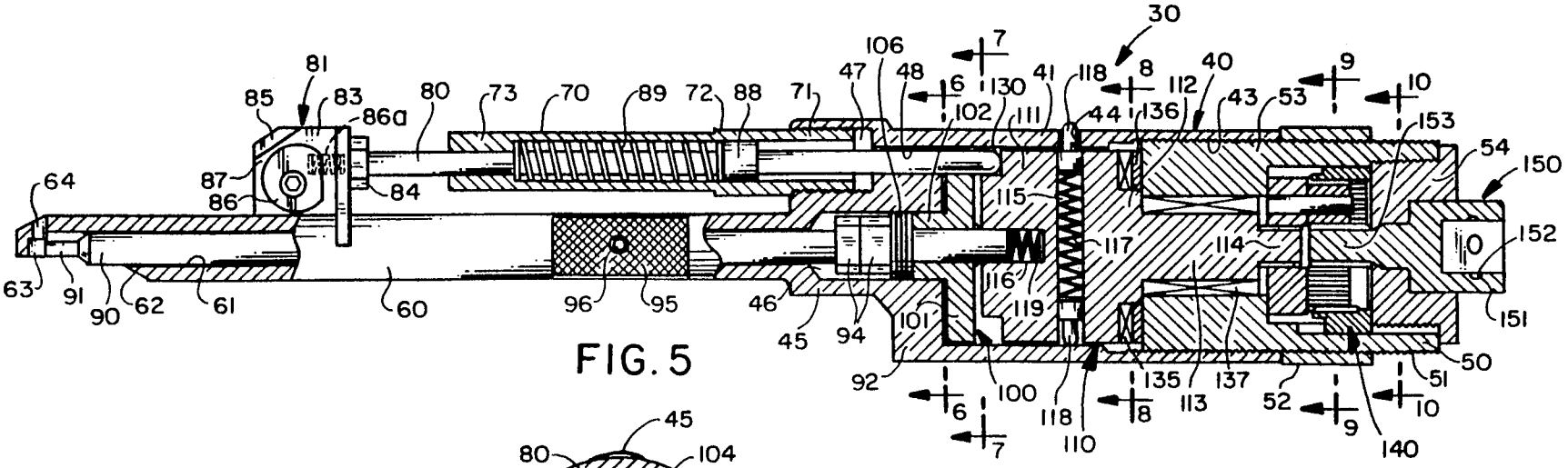
FIG. 5 is an enlarged sectional view taken along the line 5—5 of 3.
Figure 6:
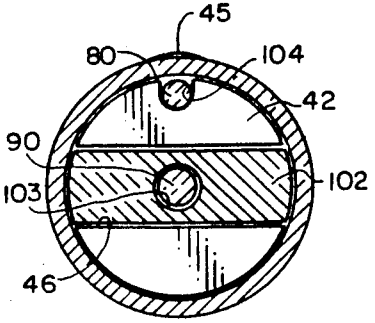
FIG. 6 is a sectional view taken along the line 6—6 of FIG. 5.

Turning now to FIGS. 2 to 5, the details of construction of the tool 30 and its mode of operation will be described. Tool 30 comprises a housing 40 in turn including a front sleeve 41, the front end of which has a shoulder 42. A hole 44 extends through the wall of sleeve 41. Most of the sleeve's internal surface 43 is threaded and its outer surface is knurled to facilitate gripping. A pedestal 45 protrudes forwardly from sleeve 41 and includes a side-to-side slot 46 (FIGS. 5,6). In the side of pedestal 45 is a threaded opening 47, which is in turn, aligned with a smaller-diameter bore 48 that projects rearwardly. Housing 40 further includes a rear sleeve 50 that has a threaded exterior surface 51 that threadedly engages surface 43. A jam nut 52 encircles sleeve 50 and abuts against the rear end of sleeve 41 in order to set sleeve 50 in its selected position after initial adjustment, as will be described. The front portion of sleeve 50 is of greater thickness, thereby defining a shoulder 53. The rear end of sleeve 50 has a threaded interior surface which threadedly receives a cap 54.

Projecting forwardly from housing 40 and specifically from pedestal 45 is a tube 60. Preferably, tube 60 is integral with pedestal 45 and sleeve 50. Pedestal 45 and tube 60 together define a tube projecting forwardly from housing 40. In tube 60 is a bore 61 aligned with slot 46. A recess 62 is formed in the front of tube 60, a portion of which defines a ferrule chamber 63 (FIG. 5). Extending through the adjacent wall of tube 60 is a hole 64. In tube 60 near the rear end thereof is an axially extending slot 65 (FIG. 4).

Tool 30 further comprises a tube 70 having a threaded end 71 which is threaded into opening 47 in pedestal 45. The combination of tube 70 and the aligned portion of pedestal 45 together define a tube projecting forwardly from housing 40. The axes of tubes 60 and 70 are substantially parallel, but in the particular embodiment depicted, tube 60 is substantially longer. Adjacent to threaded end 71 is wrenching surface 72 for use in threading tube 70 into place. The front end of tube 70 has a thicker wall, thereby defining a shoulder 73.

Referring to FIGS. 4 and 5, tool 30 further comprises a tensioning rod 80 slidably mounted in tube 70 and projecting from both ends thereof. Attached to the front end of tensioning rod 80 is gripping structure 81 for use in gripping wire 31 (FIG. 1). The front end of rod 80 is threaded at 82 into a plate 83 and held in place by a jam nut 84. Carried by plate 83 at a front corner thereof is a shoulder 85. Plate 83 also carries a rotatably and eccentrically mounted wheel 86 spring biased counterclockwise by spring 86*a*. The wire 31 is slipped into the space 87 between shoulder 85 and wheel 86. Gripper structure 81 thus defined holds onto the wire because of the eccentricity of wheel 86. A collar 88 is affixed to rod 80. A spring 89 encircles rod 80 and is disposed between collar 88 and shoulder 73, whereby rod 80 is biased rearwardly.

Tool 30 further comprises a crimping rod 90 slidably mounted in tube 60 and pedestal 45. Tip 91 at the front end of rod 90 is of reduced diameter. Rod 90 is of a length to extend from ferrule chamber 63 at the front end of tube 60 into housing 40. Rod 90 has a hole 92 and a threaded section 93 between hole 92 and its rear end. A pair of nuts 94 is threaded onto such section. A screw 96 passes through slot 65 in tube 60 and through hole 92 and is attached to a knob 95. Knob 95 constitutes a finger-gripping element whereby the user can move rod 90 rearwardly, as will be described.

Referring to FIGS. 4–7, tool 30 further comprises a cam follower 100 which includes a disc 101 from which forwardly extends a generally rectangular lug 102 having curved sides to match the inside curvature of sleeve 41. Extending through the center of disc 101 and through lug 102 is a hole 103. A hole 104 is located near the periphery of disc 101. Cam follower 100 also includes a pair of rotatably mounted rollers 105 respectively carried by axles 107 journalled into disc 101. Rollers 105 protrude rearwardly from disc 101.

Cam follower 100 is located at the front of sleeve 41, with lug 102 residing in slot 46 and disc 101 adjacent to shoulder 42. Crimping rod 90 extends through hole 103 and tensioning rod 80 extends through hole 104. Also located in slot 46, between lug 102 and nuts 94 is a stack of four compressible washers 106, known in the industry as "Belleville" washers. These are frustoconical in shape and are capable of transmitting force to the crimping rod 90 via the nuts 94 thereon. Washers 106 act to compensate for variances in crimping force, ferrule diameters and lengths of rod 90.

Figure 11:
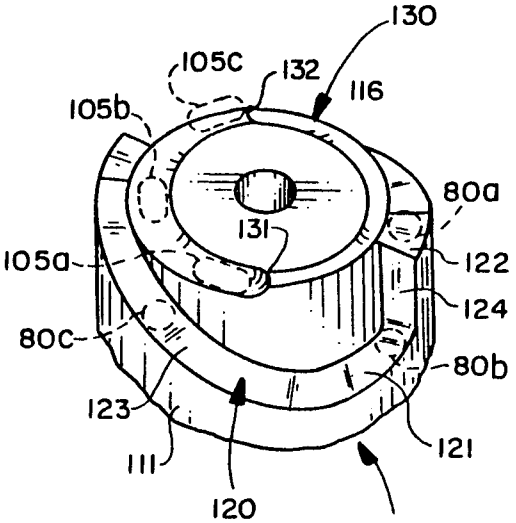
FIG. 11 is a perspective view of the cam in the tool.

Referring to FIGS. 4 and 5, tool 30 further comprises a cylindrical cam 110 which consists of a body 111, a short neck 112 protruding rearwardly from body 111, a leg 113 protruding rearwardly from neck 112 and a splined foot 114 protruding rearwardly from leg 113. Cam 110 is shown as being one piece, that is, parts 111, 112, 113 and 114 are integral. Extending transversely through body 111 is a bore 115 and extending axially and centrally through the front portion of body 111 is a bore 116 (FIG. 11). Located in bore 115 is a spring 117 and a pair of pins 118 having rounded ends. Cam 110 is mounted in housing 40 for rotation about the axis of housing 40. Spring 117 biases pins 118 outwardly and when one of the pins 118 is aligned with hole 44 in housing 40, it snaps into such hole, thereby precluding further rotation of cam 110. The other pin 118 strikes the inside wall of housing 40.

The rear end of rod 90 extends partly into bore 116. A spring 119 fills the rest of that bore. Spring 119 urges rod 90 forwardly so that tip 91 is biased against and retains a ferrule located in chamber 63.

The front of cam 110 is provided with a pair of camming surfaces 120 and 130 best seen in FIG. 11. The projection of these surfaces onto a plane perpendicular to the axis of housing 40 is annular. Surface 120 is radially outside of surface 130. Cam 110 is a means for operating rods 80 and 90. Lock nuts 94 allow adjustment of the effective length of rod 90, because it is against those nuts that force is transmitted to such rod. Camming surface 120 includes two identical segments, each segment having a rear section 121, a front section 122 and a section 123 between sections 121 and 122. In the particular embodiment depicted, sections 121 and 122 are generally planar and are perpendicular to the axis of housing 40. Section 123, in the embodiment depicted, is spiral or helical in form. Finally, camming surface 120 has a section 124 which extends axially. Sections 121 to 124 constitute one segment or 180° of camming surface 120, the remaining 180° being a second segment including a repeat of these sections In an actual embodiment, section 121 had an extent of 28°, section 122 had an extent of 24° and section 123 had an extent of 128°. It is understood that all these sections may not be necessary and sections of different configuration and extent are also within the scope of the invention described.

Camming surface 130 also includes two identical segments, each extending 180°. Surface 130 is arcuate in transverse cross section and is basically spiral or helical in form. The rise from its beginning point 131 to its end point 132 was, in a particular embodiment, 0.08 inch. Camming surface 130 could have other shapes and extents as well. In a particular embodiment, beginning point 131 was displaced about 90° from the beginning point at the middle of section 122.

Referring to FIG. 5, the rear end of tensioning rod 80 is disposed against camming surface 120. Spring 89 biases rod 80 rearwardly and, therefore, maintains contact with camming surface 120. Rollers 105 of cam follower 100 are respectively disposed against the two segments of camming surface 130.

As cam 110 rotates, camming surface 130 moves crimping rod 90 forwardly from beginning point 131 to ending point 132. Immediately after point 132, the crimping rod 90 is moved rearwardly by the beginning of the next segment of camming surface 130. During section 121 of camming surface 120, tensioning rod 80 is basically stationary, while during section 123, the tensioning rod is moved forwardly and for section 122 the tensioning rod is again stationary. It snaps back during section 124, whereupon the second segment starts.

Figure 8:
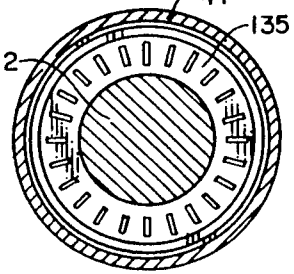
FIG. 8 is a sectional view taken along the line 8—8 of FIG. 5.
Figure 7:
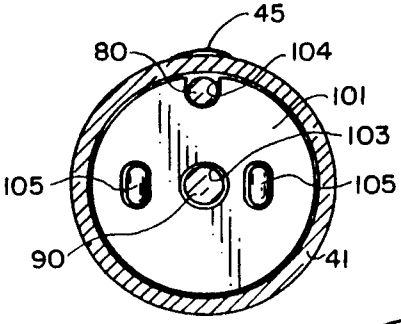
FIG. 7 is a sectional view taken along the line 7—7 of FIG. 5.

Referring to FIGS. 4, 5 and 8, encircling neck 112 of cam 110 and disposed against the rear surface of body 111 is a thrust bearing 135 consisting of a plate and a plurality of cylindrical bearings. A washer 136 is disposed between the front surface of rear sleeve 50 and bearing 135. During assembly, rear sleeve 50 is threaded into front sleeve 41 and tightened to move cam 110 forwardly against cam follower 100 which is, in turn, moved toward shoulder 42 of front sleeve 41. Nut 52 is then applied and tightened to prevent loosening of rear sleeve 50. Thrust bearing 135 permits cam 110 to rotate.

Tool 30 further comprises a cylindrical clutch 137 disposed in the annulus between rear sleeve 50 and leg 113. Clutch 137 permits only clockwise rotation of cam 110. In this application, the direction of rotation is from the perspective of the rear of the tool. Clockwise rotation reciprocates the rods 80 and 90, as will be described. The reaction on rods 80 and 90 tends to rotate cam 110 counterclockwise, but such rotation is precluded by means of clutch 137. In a specific embodiment of the invention, clutch 137 was made by The Torrington Company of Brookfield, Wis., part no. RCB081214. The advantage in using such a clutch as opposed to other one-way mechanisms is its ability to virtually preclude counterclockwise rotation, whereas other types of one-way mechanisms permit up to a few degrees of rotation. Also, with such a clutch there is no minimum on the increment of angular rotation, its construction is simple, it is quiet, occupies a minimal amount of space and provides axial alignment.

Figure 2:
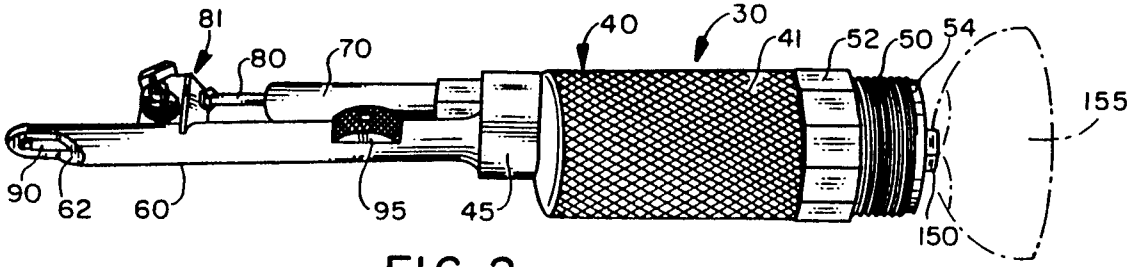
FIG. 2 is a perspective view of the tool, with a palm-grip ratchet, depicted in phantom, to rotate the actuator of such tool.
Figure 3:
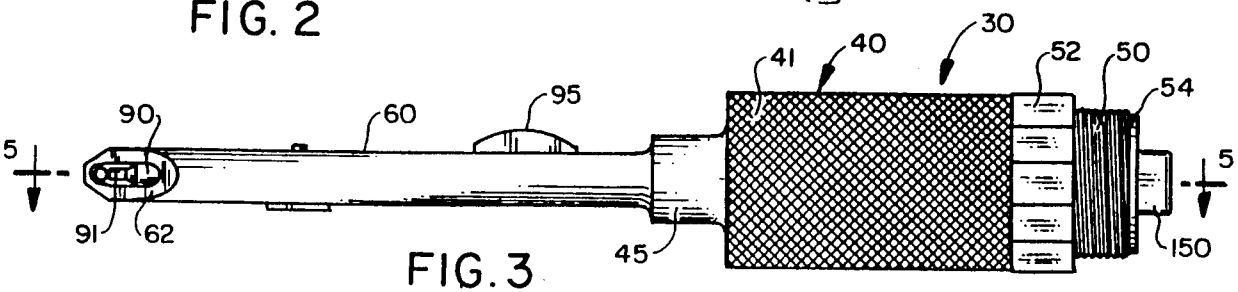
FIG. 3 is a plan view of the tool.
Figure 9:
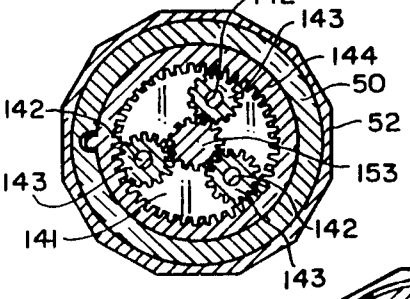
FIG. 9 is a sectional view taken along the line 9—9 of FIG. 5.
Figure 10:
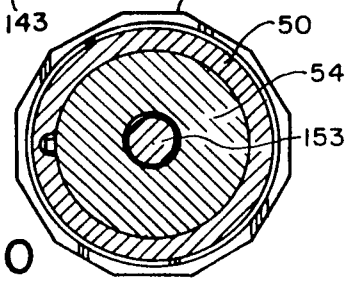
FIG. 10 is a sectional view taken along the line 10—10 of FIG. 5.

Referring to FIGS. 4, 5 and 9, tool 30 further comprises a planetary gear mechanism 140, which includes a cylindrical carrier 141 having three rearwardly extending pins 142 that respectively carry gears 143. A ring gear 144 has an internally toothed surface which engage gears 143. Finally, referring to FIGS. 4, 5 and 10, tool 30 comprises an actuator 150 having a cylindrical body 151 with a square recess 152 therein and a pinion 153 that engages gears 143. Actuator 150 is journalled into cap 54 for rotation about the axis of housing 40. Recess 152 is adapted to receive the stud of a driving tool of some kind, such as a ratchet wrench or a palm ratchet 155 (FIG. 2). Such a tool rotates clockwise and ratchets counterclockwise.

Referring to FIGS. 1, 4 and 5, in using tool 30, the operator holds it in one hand and pushes knob 95 rearwardly a small distance accommodated by the length of slot 65. Crimping rod 90 is moved rearwardly against the forward bias furnished by spring 119, thereby opening chamber 63. Preferably at point 131 (FIG. 11), there is a recess in camming surface 130 to facilitate such rearward movement of rod 90. The operator slips a ferrule into chamber 63 and releases knob 95. Spring 119 forces rod 90 forwardly and causes tip 91 to bear against the ferrule and thereby hold it. Then, wire 31 is threaded through the ferrule and hole 64. The nose of tube 60 is placed against the head of the last bolt 32 as depicted in FIG. 1. Wheel 86 of gripper structure 81 is rotated against the spring bias to a position that its edge is sufficiently spaced from shoulder 85 to insert the wire therebetween. The force tending to pull the wire from gripper structure 81 increases the retaining force due to the eccentricity of the wheel 86.

Figure 12:
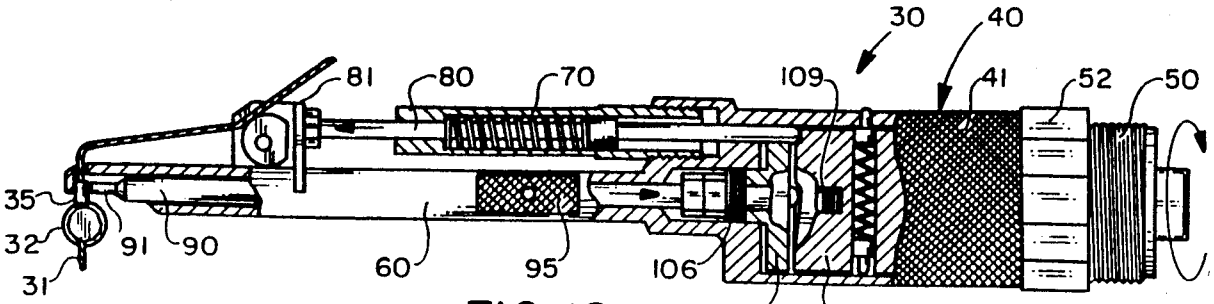
FIG. 12 is a side view of the tool, partially in elevation and partially in section, in position to start tensioning a wire.

The operator depresses the exposed pin 118. The palm ratchet 155, which had been previously applied, is gripped by the operator's other hand and is rotated to tension the wire and to crimp the ferrule. This procedure is best understood by reference to FIGS. 11 to 14. In FIG. 11, dotted circle **80*a* represents the starting position of tensioning rod 80 on camming surface 120. It is located at about the middle of section 122, that is, tensioning rod 80 is as far forward as it can be. This is the position of the tool depicted in FIG. 12. The arrow on tensioning rod 80 signifies that at this point it is still moving forwardly. Rollers 105 occupy opposite positions on camming surface 130. To facilitate explanation, reference will be made to one of the rollers. At the time corresponding to FIG. 12, roller 105 occupies position 105*a*. As is shown by the arrow in FIG. 12, crimping rod 90** is at its rearwardmost position.

As the operator turns the palm ratchet, the actuator 150 rotates in the journal furnished by cap 54, which rotation is transmitted through the planetary gear mechanism 140 to cam 110, causing it to rotate. Tensioning rod 80 rides on section 123 to section 122 and roller 105 progresses along camming surface 130 causing no crimping as yet. Continued clockwise rotation of the palm ratchet causes tensioning rod 80 to pass section 124, whereupon spring 89 causes rod 80 to snap back rearwardly, thereby pulling wire 31 taut. The position of tensioning rod 80 at this point in time on section 121 of camming surface 120 is indicated by the dotted circle 80*b*. The tensioning rod stays in its rearwardmost position for the extent of section 121. This is the position of the tool shown in FIG. 13. In the meantime, roller 105 progresses along camming surface 130 gradually pushing the crimping rod 90 forwardly. Roller 105 occupies position 105*b* when rod 80 occupies position 80*b*.

Figure 13:
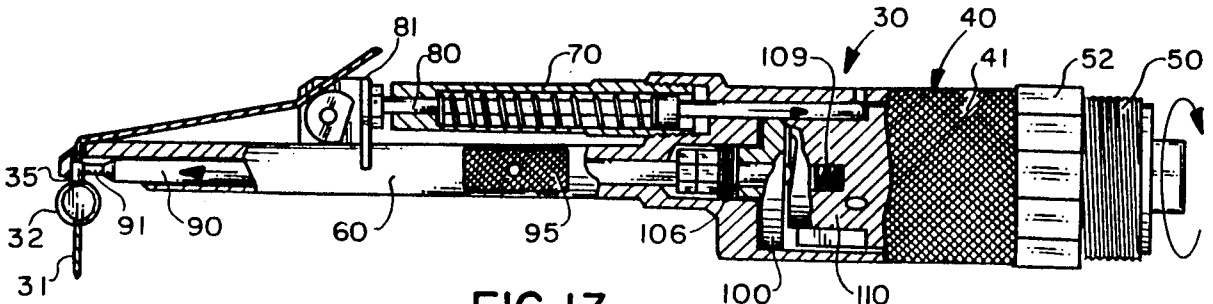
FIG. 13 is a view like FIG. 12, but with the tool in a position after have tensioned the wire and in the midst of crimping the ferrule.

The forward movement of roller 105 causes cam follower 100 to move forwardly which force is transmitted through the Belleville washers 106, to the crimping rod 90 which is moved in the direction of the arrow in FIG. 13 to crimp the ferrule held in chamber 63.

Figure 14A:
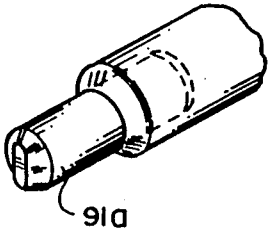
FIG. 14A is a perspective view of a replaceable tip on the crimping rod.
Figure 14:
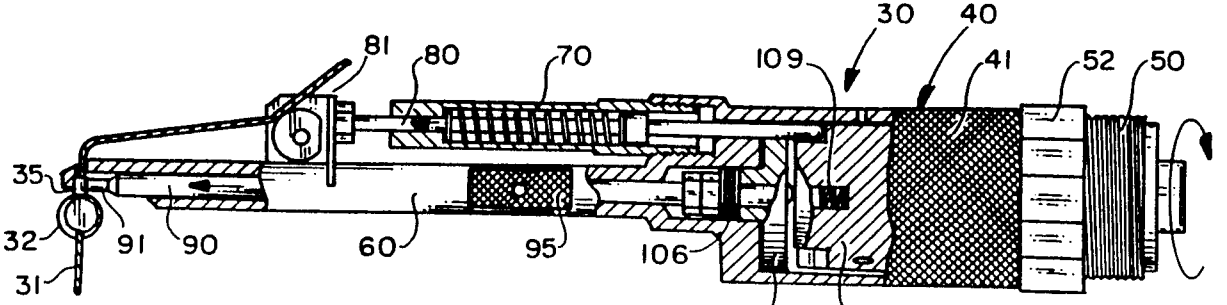
FIG. 14 is a view like FIG. 13, but with the tool in a position after having crimped the ferrule and the wire beyond the ferrule loosened.

By the time roller 105 reaches the forwardmost point on camming surface 130, as depicted in FIG. 14, and represented by position 105*c*, the ferrule is completely crimped. In the meantime, tensioning rod 80 is in contact with section 123 and is at position 80*c*. In other words, the tensioning rod is moving forwardly, as represented by the arrow in FIG. 14, to untension the portion of the wire beyond the ferrule. By the time rod 80 reaches the end of section 123, the wire will have become loosened and can be removed from the gripper structure. When rod 80 reaches section 122, the tool is in condition for the next tensioning and crimping operation and the above-described procedure is repeated. Although FIG. 11 depicts one set of positions 105*a–c*, it is understood that the second segment of camming surface 130 would have a similar set of positions. Likewise, FIG. 11 depicts a set of positions 80*a–c*. In actuality, the second segment of the camming surface 120 would have a corresponding set of positions.

Approximately at the same time roller 105 reaches position 105*a*, one of the pins 118 becomes aligned with hole 44 in housing 40 (FIG. 5). By virtue of spring 117, such pin is snapped into hole 44, thereby precluding the operator from continuing to rotate the palm ratchet. Without such detent mechanism, the operator would be able to continue to rotate cam 110, causing crimping rod 90 to move forwardly after it passes point 132 on camming surface 130, thereby reapplying the external force on the ferrule. As the tool is operated through another cycle, the same ferrule would be crimped again, which would damage the ferrule and thereby defeat the entire purpose of the lock wire system. The detent mechanism made up of pins 118 and spring 117 prevents such inadvertent recrimping of the same ferrule. In order for the operator to go through the next cycle, he must depress the exposed pin 118, whereupon the palm ratchet can be rotated once again.

As above described, cam 110 places forwardly directed forces on rod 90. The crimped ferrule exerts a reactive force rearwardly which tends to rotate cam 110 counterclockwise. Such counterclockwise rotation is precluded by one-way clutch 137. That clutch, as previously described, permits only clockwise rotation of cam 110.

FIG. 14A depicts an alternative front end to crimping rod 90. Instead of integral tip 91, a replaceable tip 91*a* can be used. Tip 91*a* has a cylindrical body which is press fit into a bore in the end of rod 90. The front end of tip 91*a* is tapered, terminating at an elongated front face, i.e., is chisel-shaped. Tip 91*a* is mounted such that the direction of elongation of the front face is parallel to the axis of the ferrule. Thus, the crimp formed in the ferrule will be elongated and parallel to the axis of the ferrule. The tip, after substantial use, tends to wear. By using this particular construction, the tip can be replaced as needed. A tip with an elongated face on a tapered neck is advantageous in that it reduces the energy necessary to collapse the ferrule and requires less force to perform the crimping operation. Also an elongated crimp tends to reduce the possibility of the ferrule cracking and also provides better holding power with the lock wire.

Turning now to FIGS. 15 to 19, another embodiment of the present invention will be described. Depicted in these figures is a tool 160. Tool 160 comprises a housing 170, in turn including a rectangular block 171 having a channel 172 extending axially (longitudinal axis of tool 160) therein. Attached to one side of the block is an elongated plate 173 having an elongated, axially extending opening 174 near the front thereof. On the other side of block 171 is a plate 175 having substantially the same shape as plate 173. A slot 176 (FIG. 18) in plate 175 also extends axially. Screws 177 attach plates 173 and 175 to block 171. Block 171 further includes a longitudinally extending bore 178 (FIG. 18), the front of which is of smaller diameter to define a shoulder 179.

Figure 17:
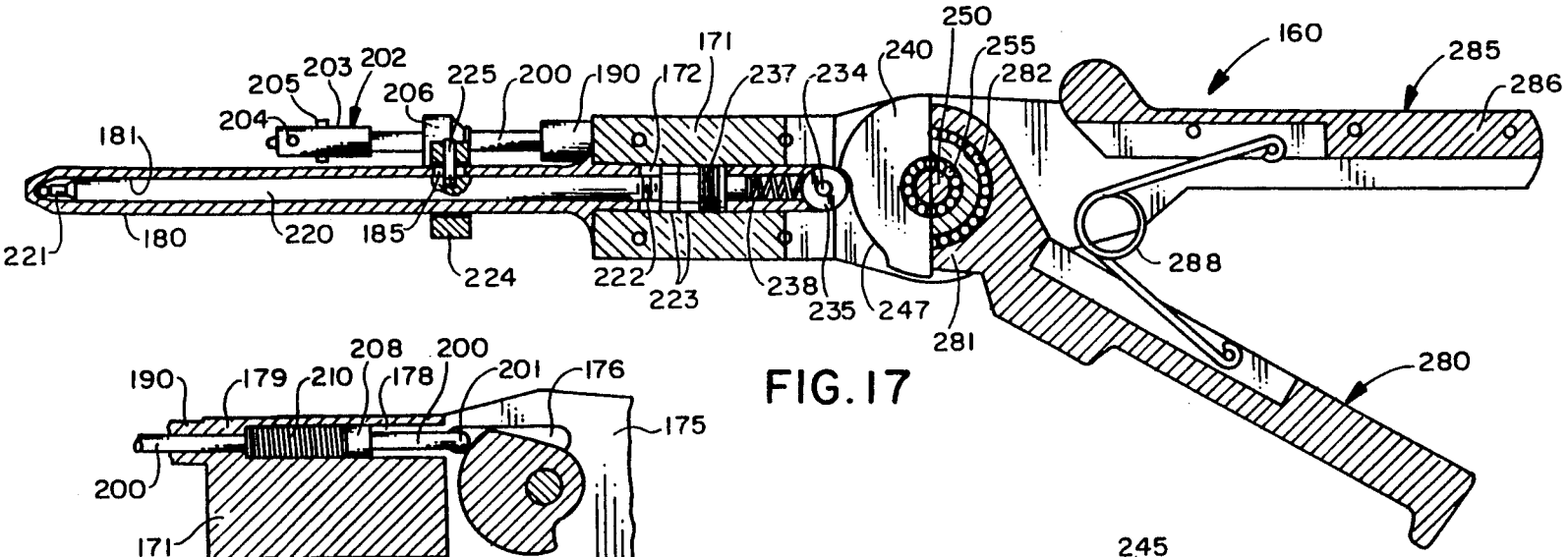
FIG. 17 is a sectional view taken along the line 17—17 of FIG. 16.

Projecting forwardly from housing 170 is a tube 180 having a bore 181. A recess 182 is formed in the front of tube 180, a portion of which defines a ferrule chamber 183. On the adjacent wall of tube 180 is a hole 184. In the wall of tube 180 near the rear end thereof is an axially extending slot 185 (FIG. 17).

Tool 160 further comprises a tube 190 projecting forwardly from housing 170. The axes of tubes 180 and 190 are substantially parallel. In the embodiment depicted, tube 180 is substantially longer. The bore in tube 190 is aligned with bore 178 of block 171.

Figure 24:
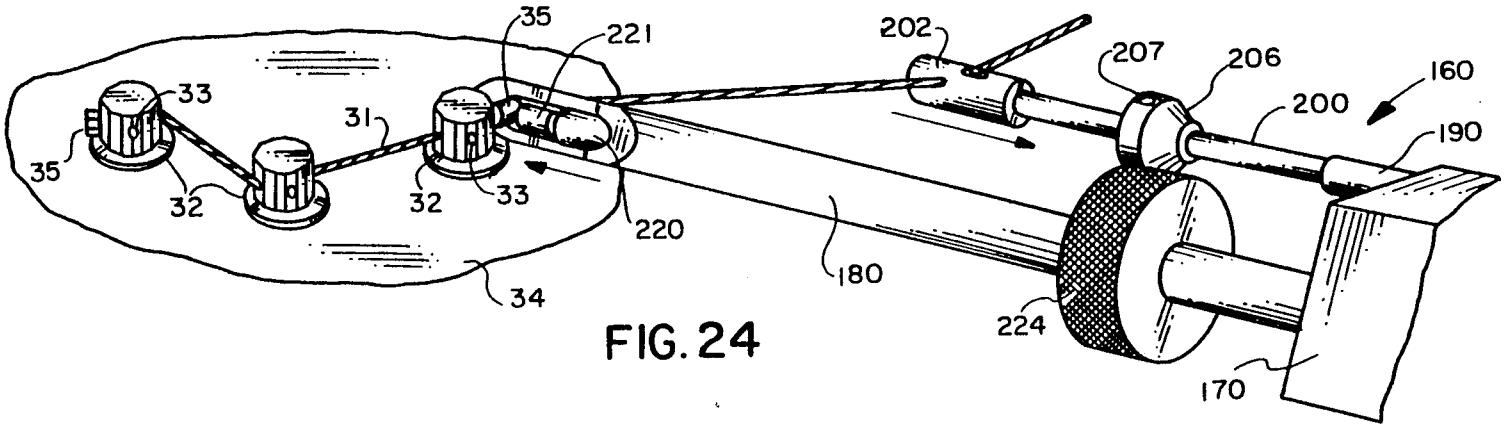
FIG. 24 a perspective view of the second embodiment being used to tension a wire and apply a ferrule thereto.

Tool 160 further comprises a tensioning rod 200 slidably mounted in tube 190 and in bore 178. The rear end 201 of rod 200 is bent outwardly so as to extend through slot 176. On the front end of tensioning rod 200 is gripping structure 202 for use in gripping wire 31 (FIG. 1). The gripping structure comprises a reciprocable sleeve 203 having a hole 204 therein. A pin 205 attached to the end of the rod 200 and passing through aligned slots (not shown) in sleeve 203 permits sleeve 203 to reciprocate. A hole (not shown) in rod 200 is aligned with hole 204 to enable a wire to be threaded therethrough and to be retained by sleeve 203. A collar 206 is affixed at a generally central position on rod 200 by means of a set screw 207 (FIG. 24). As will be described, tensioning rod 200 snaps back during operation of tool 160. Collar 206 limits the extent of such movement by striking the front of tube 190.

Figure 18:
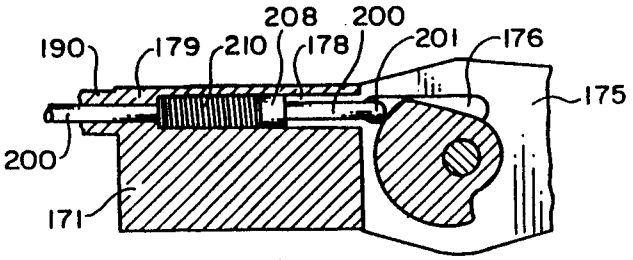
FIG. 18 is a sectional view taken along the line 18—18 of FIG. 16.

Referring to FIG. 18, a collar 208 is attached to a point on tensioning rod 200 within bore 178. A spring 210 encircles rod 200 and is disposed between collar 208 and shoulder 179, whereby rod 200 is biased rearwardly.

Tool 160 further comprises a crimping rod 220 located in tube 180 and the aligned bore in block 171 of housing 170. Tip 221 at the front of rod 220 is of reduced diameter. Rod 220 is of a length to extend from ferrule chamber 183 at the front of tube 180 into housing 170. Rod 220 has a threaded portion 222 near the rear end. A pair of nuts 223 is threaded onto such section. A ring-like knob 224 encircles rod 220 and is of larger diameter so as to be reciprocable with respect thereto. A set screw 225 extends through knob 224 and slot 185 in tube 180, and is threaded into rod 220. Knob 224 constitutes a finger-gripping element, with which the user can move rod 220 rearwardly, as will be described.

Figure 19:
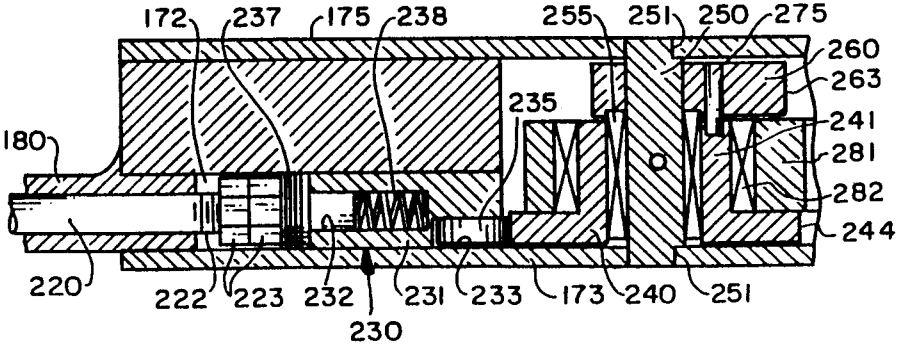
FIG. 19 is an enlarged sectional view taken along the line 19—19 of FIG. 15.

Referring to FIGS. 17 to 19, tool 160 comprises a cam follower 230, which includes an elongated block 231 having a width slightly less than the width of channel 172 in housing 170. Extending axially through the front portion of block 231 is a bore 232. At the rear of block 231 on one side thereof is a recess 233. Extending from the side of block 231 into such recess is a pin 234 journalled into a roller 235. Cam follower 230 is slidably mounted in channel 172.

Crimping rod 220 extends into bore 232. Also located in channel 172, between block 231 and nuts 223 is a stack of four compressible washers 237, which are preferably of the Belleville type. A spring 238 is located in the rear of bore 232 and is disposed against the rear end of rod 220 so that its tip 221 is biased against and retains a ferrule located in ferrule chamber 183.

Figure 20:
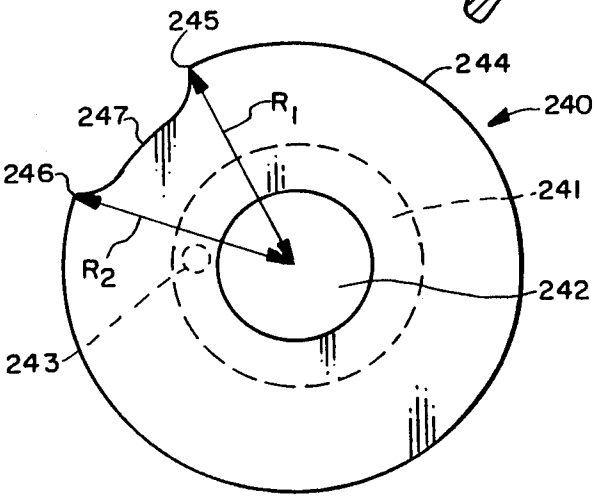
FIG. 20 is an elevational view of one side of the main or crimping cam.
Figure 21:
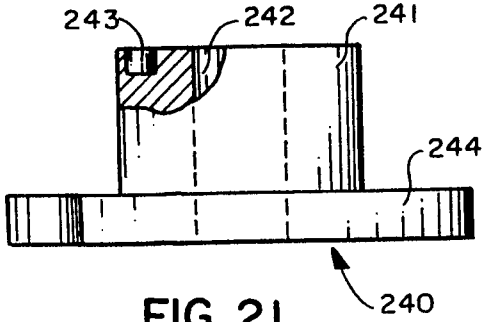
FIG. 21 is a top plan view of the crimping cam with a portion cut away.

Referring to FIGS. 19 to 21, tool 160 further comprises a disc-shaped crimping cam 240 carrying a sidewardly protruding hub 241 with a bore 242 extending therethrough. In the distal end of hub 241 is a hole 243. Cam 240 has a camming surface 244 with a beginning point 245 and an end point 246. The radius $R_2$ of camming surface 244 at end point 246 is greater than radius $R_1$ at beginning point 245. In a particular embodiment, $R_2$ was greater than $R_1$ by 0.05 inch and the increase was generally linearly proportional to the angle of rotation between points 245 and 246. Camming surface 244 also has a recess 247 following end point 246. Follower roller 235 is biased against camming surface 244. As cam 240 is caused to rotate counterclockwise, starting from beginning point 245, crimping rod 220 is caused to steadily move forwardly until point 246. When recess 247 is aligned with roller 235, the user may grip knob 224 to move crimping rod 220 attached thereto rearwardly and thereby open the ferrule chamber 183 to receive a ferrule therein.

Tool 160 further comprises a shaft 250 having flattened ends 251 (FIG. 19). Housing plates 173 and 175 have laterally aligned D-shaped openings that respectively receive flattened ends 251, thereby non-rotatably mounting the shaft to housing 170. The shaft passes through hub 241. Tool 160 further comprises a cylindrical clutch 255 disposed in the annulus between hub 241 and shaft 250. Clutch 255 permits only clockwise rotation of hub 241, thus clockwise rotation of crimping cam 240. Clockwise rotation reciprocates crimping rod 220, as will be described. The reaction on rod 220 tends to rotate cam 240 counter-clockwise, but such rotation is precluded by means of clutch 255. In a specific embodiment of the invention, clutch 255 was made by The Torrington Company, part no. RCB-061014-FS. The advantages in using such a clutch were explained in reference to the first embodiment.

Figure 23:
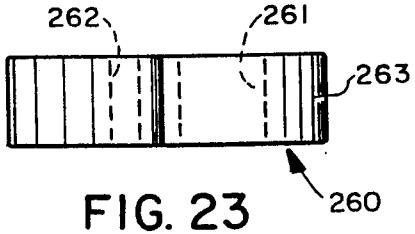
FIG. 23 is a top plan view of the tensioning cam.
Figure 22:
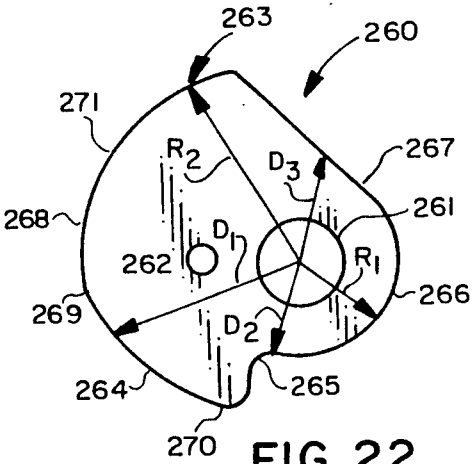
FIG. 22 is an elevational view of the secondary or tensioning cam.

Tool 160 further comprises a tensioning cam 260 depicted in FIGS. 22 and 23 as having a bore 261 and a hole 262 therethrough. A camming surface 263 made up of five sections 264–268. The distance $D_1$ from the center of bore 261 to section 264 from beginning point 269 to ending point 270 decreases. Section 265 is relatively short and is a distance $D_2$ less than $D_1$. The third section 266 is part-circular having a radius $R_1$ and the section 268 is part-circular having a greater radius, $R_2$. The section 267 is flat, its distance $D_3$ from the center of bore 261 increasing from $R_1$ to $R_2$.

Referring to FIG. 19, cam 260 is mounted in housing 170 such that shaft 250 extends through bore 261. A pin 275 extends through hole 262 of cam 260 and hole 243 of cam 240, whereby cams 240 and 260 rotate together about an axis perpendicular to the axes of rods 200 and 220. In the particular embodiment depicted, hub 241 is integral with cam 240 and cam 260 is pinned to hub 241. Other constructions are possible, such as separate cams both pinned to the hub or an integral member consisting of the two cams and a hub.

Referring to FIG. 22, consider tensioning rod 200 at point 271 of section 268 of camming surface 263, whereupon rod 200 is at its forwardmost position. Spring 210 biases rod 200 firmly against camming surface 263. As cam 260 rotates counterclockwise, it becomes aligned with section 267 whereupon there is no longer any restraint on rod 200 and it snaps rearwardly by the action of spring 210, limited by collar 206 striking tube 190. Collar 206 had been initially set at a selected position on rod 200. Continued rotation of cam 260 aligns section 266 with tensioning rod 200. It has no effect because that section does not contact rod 200. In other words, its radius $R_1$ is less than the distance from the center of shaft 250 to rod 200. Continued rotation of cam 260 places section 265 in contact with rod 200 causing rod 200 to be moved forwardly. Continued counterclockwise rotation of the cam 260 places section 264 in contact with rod 200 causing rod 200 to continue to be moved forwardly. Such forward movement ends at surface 268 which maintains tensioning rod 200 substantially fixed.

The relationship of cams 240 and 260 is such that when rod 200 is at point 271, roller 235 becomes aligned with the beginning of recess 247 (FIG. 20).

Referring to FIGS. 17 and 19, to actuate or rotate cams 240 and 260, handle 280 is provided, which has a ring-shaped end 281 through which hub 241 extends. A cylindrical clutch 282 is disposed in the annulus between end 281 and hub 241. Clutch 282 permits only clockwise torque to be imparted to hub 241 in response to reciprocation of the handle 280. It is preferably also a Torrington bearing model no. RC-162110-FS.

Figure 15:
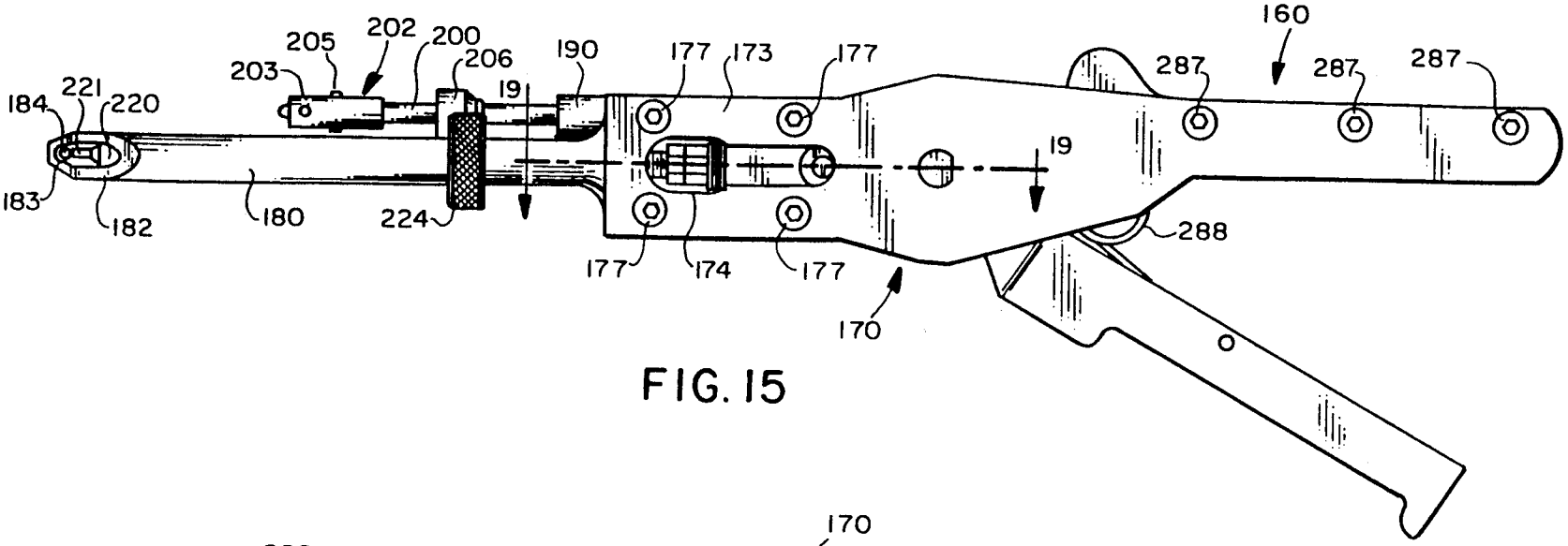
FIG. 15 is a side elevational view of a tool incorporating a further embodiment of the invention.
Figure 16:
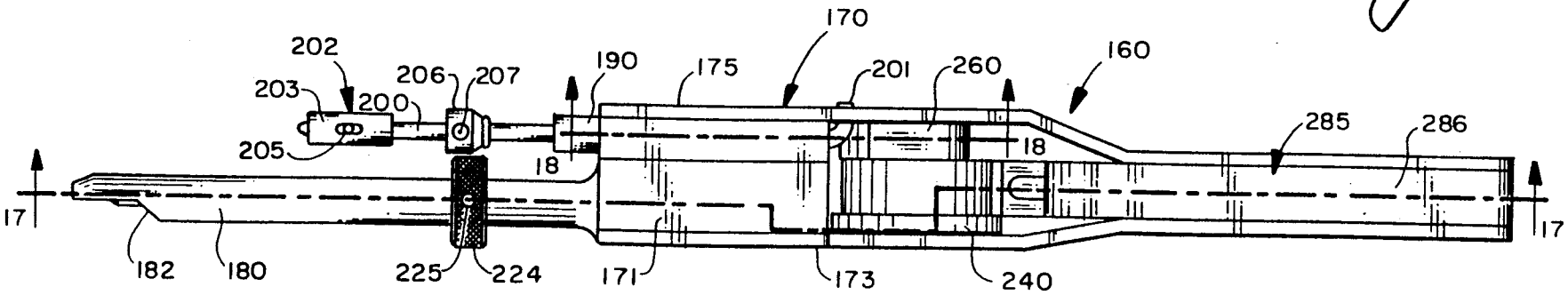
FIG. 16 is a top plan view of the further embodiment.

Tool 160 further comprises a fixed handle 285 being an elongated core 286 disposed between rear strip portions of plates 273 and 275 and secured by screws 287 (FIG. 15). Movable handle 280 is pivotable toward and away from fixed handle 285. A spring 288 biases the handle 280 away from handle 285.

Referring to FIG. 17, in using tool 160, the operator holds it in one hand and pushes knob 224 rearwardly a small distance accommodated by the length of slot 185. Recess 247 in cam 240 accommodates such rearward movement. Crimping rod 220 is moved rearwardly against the forward bias furnished by spring 238, thereby opening chamber 183. Then, referring to FIG. 24, wire 31 is threaded through the ferrule and hole 184 (FIG. 15). The nose of tube 180 is placed against the head of the last bolt. Sleeve 203 of gripper structure 202 is drawn rearwardly and the wire is threaded through the hole 204 and the aligned hole in rod 200. The wire is thereby attached to the forward end of the rod 200. The operator grabs the handles 280 and 285 much like a pair of side cutters and the handle 280 is reciprocated to tension the wire and crimp the ferrule.

Point 271 on section 268 of camming surface 263 of cam 260 is aligned with rod 200, and the beginning of recess 247 is aligned with cam follower roller 235. As the operator pivots handle 280, that is, moves it upwardly toward handle 285, ring-shaped end 281 rotates counterclockwise. Clutch 282 transmits such motion to hub 241, causing cam 240 to rotate counterclockwise as well. When section 267 is aligned with rod 200, it snaps back, thereby tensioning the wire. At the same time cam follower roller 235 reaches the end of recess 247.

The operator releases handle 280, whereby the spring 288 pivots handle 280 downwardly, causing its ring-shaped end 281 to rotate clockwise. That movement is insulated from hub 241 by virtue of clutch 282. Thus, both cams 240 and 260 remain stationary during the downward movement of handle 285. The operator again pivots handle 280 upwardly causing camming surface 244 to move crimping rod 220 steadily forwardly to crimp the ferrule. At the same time, cam 260 continues to rotate, but has no effect because rod 220 is aligned with section 266. Section 265 moves the tensioning rod forwardly, thereby loosening that portion of the wire beyond the crimped ferrule. As crimping continues, section 264 becomes aligned with the tensioning rod which continues to move rod 200 forwardly. At point 269, the tensioning rod is at its forwardmost position. As crimping continues, section 268 maintains the tensioning rod stationary until point 271 is reached whereupon the tool can be removed and a new ferrule crimped.

As above described, cam 240 is placing forwardly directed forces on crimping rod 220. The crimped ferrule exerts a reactive force rearwardly which tends to rotate cam 240 clockwise. Such clockwise rotation is precluded by one-way clutch 255. That clutch, as previously described, permits only counterclockwise rotation of cam 240.

What has been described therefor is a tensioning and crimping tool that tensions a lock wire and then automatically crimps a ferrule onto the lock wire to hold it in place. While various embodiments of the invention have been described, it will be understood to those skilled in the art that various changes can be made therein yet come within the spirit and scope of the following claims which define the scope of protection of this invention.

What is claimed is:

1. A tensioning and crimping tool comprising means for tensioning a wire, holding and crimping means for holding a ferrule and for crimping the ferrule onto the wire after the wire has been tensioned, means for operating said tensioning means and said crimping means, said holding and crimping means including a movable member positionable to hold the ferrule and then to crimp the ferrule in response to said operating means, and hand-operated means for actuating said operating means.

2. The tensioning and crimping tool of claim 1, wherein said crimping means is movable between crimping and non-crimping positions, and further comprising means for biasing said crimping means to the crimping position thereof.

3. The tensioning and crimping tool of claim 2, and further comprising means for moving said crimping means to the non-crimping position thereof against the action of said biasing means.

4. The tensioning and crimping tool of claim 1, wherein said tensioning means includes a cam follower and said crimping means includes a cam follower and said operating means includes camming surfaces respectively in engagement with said cam followers.

5. The tensioning and crimping tool of claim 1, wherein said tensioning means is movable between tensioning and non-tensioning positions, and further comprising means for urging said tensioning means to the tensioning position thereof.

6. The tensioning and crimping tool of claim 5, wherein said operating means includes means having a first portion for restraining movement of said tensioning means and having a second portion for releasing said tensioning means to cause movement to the tensioning position thereof.

7. The tensioning and crimping tool of claim 1, and further comprising means for compressibly coupling said operating means to said crimping means.

8. The tensioning and crimping tool of claim 1, wherein said tensioning means includes means for releasably gripping the wire.

9. The tensioning and crimping tool of claim 1, wherein said tensioning means includes a rod, spring means for biasing said rod in a tensioning direction, means for restraining said tensioning rod and means for terminating the restraint furnished by said restraining means.

10. The tensioning and crimping tool of claim 1, and further comprising means for precluding continued operation of said crimping means on a ferrule after the ferrule has been crimped.

11. The tensioning and crimping tool of claim 1, and further comprising means for precluding reverse movement of said operating means.

12. The tensioning and crimping tools of claim 1, and further comprising means for initially adjusting said tensioning means and said crimping means.

13. A tensioning and crimping tool comprising a housing, a tensioning tube projecting forwardly from said housing, a tensioning rod slidably mounted in said tensioning tube, means on the front end of said tensioning rod for gripping a wire, tensioning-rod operating means for moving said tensioning rod rearwardly to tension a wire, a crimping tube projecting forwardly from said housing and being substantially parallel to said tensioning tube, means at the front end of said crimping tube defining a ferrule chamber, a crimping rod slidably mounted in said crimping tube and extending from said chamber to said housing, crimping-rod operating means for moving the front end of said crimping rod into said chamber and thereby crimp a ferrule therein, actuating means coupled to both of said operating means, and hand-operated means for actuating said tensioning-rod operating means and said crimping-rod operating means.

14. The tensioning and crimping rod of claim 13, wherein said tensioning-rod operating means includes means for rearwardly biasing said tensioning rod.

15. The tensioning and crimping tool of claim 13, and further comprising means for forwardly biasing said crimping rod.

16. The tensioning and crimping tool of claim 15, and further comprising finger-operated means for moving said crimping rod rearwardly to enable insertion of a ferrule in said chamber.

17. The tensioning and crimping tool of claim 13, wherein said tensioning-rod operating means includes a camming surface, and said crimping-rod operating means includes a camming surface.

18. The tensioning and crimping tool of claim 13, wherein said tensioning-rod operating means includes means for biasing said tensioning rod rearwardly, means for restraining movement of said tensioning rod and means for releasing said tensioning rod to cause tensioning of the wire.

19. The tensioning and crimping tool of claim 13, and further comprising means for compressibly coupling said crimping-rod operating means to said crimping rod.

20. The tensioning and crimping tool of claim 13, wherein said crimping-rod operating means includes a cam and a cam follower coupling said cam to said crimping rod.

21. The tensioning and crimping tool of claim 20, and further comprising means for compressibly coupling said cam follower to said crimping rod.

22. The tensioning and crimping tool of claim 13, wherein said tensioning-rod operating means includes a cam having a first portion that gradually moves said tensioning rod forwardly and a second portion that enables said tensioning rod to snap back rearwardly to tension the wire.

23. The tensioning and crimping tool of claim 13, wherein said crimping rod has a chisel-shaped front end.

24. The tensioning and crimping tool of claim 13, and further comprising a replaceable tip on the front end of said crimping rod.

25. The tensioning and crimping tool of claim 24, wherein said replaceable tip has a chisel-shaped front end.

26. The tensioning and crimping tool of claim 13, and further comprising a one-way clutch between said actuating means and both of said operating means.

27. The tensioning and crimping tool of claim 13, and further comprising a cam having a first camming surface being part of said tensioning-rod operating means and a second camming surface being part of said crimping-rod operating means.

28. The tensioning and crimping tool of claim 13, wherein said tensioning-rod operating means includes a first cam coupled between said actuating means and said tensioning rod, said crimping-rod operating means including a second cam between said actuating means and said crimping rod.

29. The tensioning and crimping tool of claim 13, wherein said actuating means is rotatably mounted about an axis substantially parallel to the axes of said tensioning and crimping rods.

30. The tensioning and crimping tool of claim 13, wherein said actuating means is pivotally mounted on said housing.

31. The tensioning and crimping tool of claim 13, wherein said actuating means is constructed and arranged to receive a further tool for actuation thereof.

32. The tensioning and crimping tool of claim 13, and further comprising means for precluding continued operation of said crimping rod on a ferrule after the ferrule has been crimped.

33. The tensioning and crimping tool of claim 13, and further comprising means for precluding reverse movement of said crimping-rod operating means.

34. The tensioning and crimping tool of claim 13, and further comprising means for making an initial adjustment of said tensioning rod and said crimping rod.

35. A tensioning and crimping tool comprising a housing, a tensioning tube projecting forwardly from said housing, a tensioning rod slidably mounted in said tensioning tube, means on the front end of said tensioning rod for gripping a wire, tensioning-rod operating means for moving said tensioning rod rearwardly to tension a wire, a crimping tube projecting forwardly from said housing and being substantially parallel to said tensioning tube, means at the front end of said crimping tube defining a ferrule chamber, a crimping rod slidably mounted in said crimping tube and extending from said chamber to said housing, crimping-rod operating means for moving the front end of said crimping rod into said chamber and thereby crimp a ferrule therein, and actuating means mounted on said housing for rotation about an axis substantially parallel to the axes of said tensioning and crimping rods and being couple to both of said operating means.

36. The tensioning and crimping tool of claim 35, wherein said actuating means includes a recess of polygonal cross section for receiving the stud of a driver tool.

37. The tensioning and crimping tool of claim 35, wherein said housing is a substantially cylindrical tube.

38. The tensioning and crimping tool of claim 35, wherein said housing includes threadably interconnected cylindrical front and rear sleeves, said tensioning and crimping tubes being located at the front end of said front sleeve and said actuating means being located at the rear end of said rear sleeve.

39. The tensioning and crimping tool of claim 35, and further comprising a planetary gear mechanism coupling said actuating means to said tensioning-rod operating means and said crimping-rod operating means.

40. The tensioning and crimping tool of claim 35, and further comprising a cam mounted in said housing for rotation about an axis parallel to the axis of rotation of said actuating means, said cam being operatively coupled to said actuating means, said tensioning-rod operating means including a first camming surface on said cam, said crimping-rod operating means including a second camming surface on said cam.

41. The tensioning and crimping tool of claim 40, wherein said crimping rod has a threaded portion, said crimping-rod operating means including nut means on said threaded portion and further comprising a stack of compressible washers between said second camming surface and said nut means.

42. The tensioning and crimping tool of claim 40, wherein said cam includes an axially extending bore receiving the rear end of said crimping rod, a spring in said bore and encircling said rear end and biasing said crimping rod forwardly to cause the front end of said crimping rod to push against a ferrule in said chamber.

43. The tensioning and crimping tool of claim 40, wherein said housing includes a cylindrical front sleeve and a cylindrical rear sleeve which are threadedly interconnected, said rear sleeve being threaded into said front sleeve so as to be disposed against the rear of said cam and thereby hold same in position.

44. The tensioning and crimping tool of claim 43, wherein said rear sleeve has a threaded exterior surface, and further comprising a jam nut on said exterior surface and abutting against the rear of said front sleeve, thereby enabling adjustment of the initial positions of said tensioning rod and said crimping rod.

45. The tensioning and crimping tool of claim 44, and further comprising a thrust bearing between said rear sleeve and said cam.

46. The tensioning and crimping tool of claim 40, and further comprising detent means on said cam and on said front sleeve and being constructed and arranged to preclude further movement of said actuating means after a ferrule has been crimped, said detent means being disengageable to permit a next cycle of said tool.

47. The tensioning and crimping tool of claim 40, wherein said second camming surface includes two repeating segments for operating said crimping rod.

48. The tensioning and crimping tool of claim 35, wherein said crimping-rod operating means includes a cam, a carrier, a cam follower on said carrier in engagement with said cam, and means for compressibly coupling said carrier to said crimping rod.

49. The tensioning and crimping tool of claim 48, wherein said cam follower includes a pin on said carrier and a ring rotatably mounted on said pin.

50. The tensioning and crimping tool of claim 35, wherein said crimping-rod operating means includes a cam having a main portion for gradually moving said crimping rod forwardly and a recessed portion to accommodate rearward movement of said crimping rod and thereby open said chamber to receive a ferrule.

51. The tensioning and crimping tool of claim 35, wherein said crimping-rod operating means includes a cam having a head portion, a body portion located rearwardly of said head portion and a foot portion located rearwardly of said body portion.

52. The tensioning and crimping tool of claim 51, and further comprising a one-way clutch between said housing and said body portion.

53. The tensioning and crimping tool of claim 35, and further comprising means compressibly coupling said crimping-rod operating means to said crimping rod.

54. A tensioning and crimping tool comprising a housing, a tensioning tube projecting forwardly from said housing, a tensioning rod slidably mounted in said tensioning tube, means on the front end of said tensioning rod for gripping a wire, means for rearwardly biasing said tensioning rod, tensioning-rod operating means having a first portion restraining rearward movement of said tensioning rod and having a second portion for releasing said tensioning rod to cause tensioning of said wire, a crimping tube projecting forwardly from said housing and being substantially parallel to said tensioning tube, means at the front end of said crimping tube defining a ferrule chamber, a crimping rod slidably mounted in said crimping tube and extending from said chamber to said housing, crimping-rod operating means for moving the front end of said crimping rod into said chamber and thereby crimp a ferrule therein, and actuating means mounted in said housing for rotation about an axis substantially parallel to the axes of said tensioning and crimping rods and being coupled to both of said operating means.

55. The tensioning and crimping tool of claim 54, wherein said tensioning-rod operating means includes a camming surface having a generally axially extending portion over which said tensioning rod is snapped rearwardly to tension the wire.

56. The tensioning and crimping tool of claim 55, wherein said camming surface has a generally transversely extending portion following said axially extending surface over which said tensioning rod is substantially stationary.

57. The tensioning and crimping tool of claim 56, wherein said camming surface has a third portion of gradual rise for gradually moving said tensioning rod forwardly.

58. The tensioning and crimping tool of claim 57, wherein said camming surface has a fourth portion following said third portion over which said tensioning rod is substantially stationary.

59. The tensioning and crimping tool of claim 58, wherein said camming surface includes two sections each having said four portions.

60. A tensioning and crimping tool comprising a housing, a tensioning tube projecting forwardly from said housing, a tensioning rod slidably mounted in said tensioning tube, means on the front end of said tensioning rod for gripping a wire, means for rearwardly biasing said tensioning rod, tensioning-rod operating means having a first portion restraining rearward movement of said tensioning rod and having a second portion for releasing said tensioning rod to cause tensioning of said wire, a crimping tube projecting forwardly from said housing and being substantially parallel to said tensioning tube, means at the front end of said crimping tube defining a ferrule chamber, a crimping rod slidably mounted in said crimping tube and extending from said chamber to said housing, crimping-rod operating means for moving the front end of said crimping rod into said chamber and thereby crimp a ferrule therein, and handle means pivotally mounted on said housing and coupled to said tensioning-rod operating means and to said crimping-rod operating means.

61. The tensioning and crimping tool of claim 60, wherein said handle means is pivotable in one direction to cause said tension-rod operating means and said crimping-rod operating means to operate, said tension-rod operating means and said crimping-rod operating means being unresponsive to pivoting movement of said handle in the opposite direction.

62. The tensioning and crimping tool of claim 61 and further comprising clutch means between said handle and both of said operating means.

63. The tensioning and crimping tool of claim 60, wherein said tensioning-rod operating means includes a first cam and said crimping-rod operating means includes a second cam.

64. The tensioning and crimping tool of claim 61 and further comprising a fixed handle projecting rearwardly from said housing, said handle means being pivotal toward said fixed handle to operate said operating means.

65. The tensioning and crimping tool of claim 64, and further comprising means biasing said handle means away from said fixed handle.

66. The tensioning and crimping tool of claim 60, wherein said handle includes a ring-shaped end, said tensioning-rod operating means including a cam, a hub on said cam and residing in said ring-shaped end, clutch means between said hub and said ring-shaped end.

67. The tensioning and crimping tool of claim 66, wherein said hub is integral with said cam.

68. The tensioning and crimping tool of claim 60, wherein said crimping-rod operating means includes a cam having a camming surface engaging said crimping rod for effecting forward movement thereof, said cam having a recessed portion to receive the rear end of said crimping rod to open said ferrule chamber to receive a ferrule.

69. The tensioning and crimping tool of claim 60, and further comprising a hub coupled to said crimping-rod operating means and said tensioning-rod operating means, a shaft through said hub and non-rotatably carried by said housing, cylindrical one-way first clutch means between said hub and said shaft and being operative to enable rotation of said hub in one direction with respect to said shaft and not in the other direction, said handle having a ring-shaped end, said hub residing in said ring-shaped end, cylindrical one-way second clutch means between said hub and said ring-shaped end.

70. The tensioning and crimping tool of claim 69, wherein each of said clutch means includes a tubular frame and a plurality of cylindrical bearings carried thereby.

71. The tensioning and crimping tool of claim 60, wherein said crimping-rod operating means includes a block, a ring-shaped cam follower rotatably carried by said block, and a cam in engagement with said cam follower, said block being coupled to the rear end of said tensioning rod.

72. The tensioning and crimping tool of claim 71, wherein said crimping-rod operating means includes means compressibly coupling said block to said crimping rod.

73. The tensioning and crimping tool of claim 71, wherein the rear end of said crimping rod is threaded, and further comprising nut means on said threaded end, a stack of compressible washers between said block and said nut means.

74. The tensioning and crimping tool of claim 71, wherein said block includes an axially extending bore receiving the rear end of said tensioning rod, a spring in said bore and encircling said rear end and biasing said tensioning rod forwardly to cause the front end of said rod to push against a ferrule in said chamber.

75. The tensioning and crimping tool of claim 60, wherein said crimping-rod operating means includes a crimping cam and said tensioning-rod operating means includes a tensioning cam, said crimping cam and said tensioning cam being pinned together so as to rotate jointly in response to movement of said handle.

* * * * *